US008646298B2

(12) United States Patent
Lessels

(10) Patent No.: US 8,646,298 B2
(45) Date of Patent: Feb. 11, 2014

(54) ELECTRONICALLY-CONFIGURABLE KEY

(76) Inventor: Peter J. Lessels, Cornish, NH (US)

( * ) Notice: Subject to any disclaimer, the term of this patent is extended or adjusted under 35 U.S.C. 154(b) by 154 days.

(21) Appl. No.: 13/410,354

(22) Filed: Mar. 2, 2012

(65) Prior Publication Data

US 2012/0222460 A1 Sep. 6, 2012

Related U.S. Application Data

(60) Provisional application No. 61/448,711, filed on Mar. 3, 2011.

(51) Int. Cl.
*E05B 25/00* (2006.01)

(52) U.S. Cl.
USPC ..... 70/383; 340/5.2; 340/5.22; 340/5.6; 340/5.67; 70/275; 70/491; 70/493; 70/496; 70/409; 70/278.2; 70/278.3; 70/351; 70/398; 70/411

(58) Field of Classification Search
USPC ..... 340/5.2–5.6; 70/275, 491, 493, 496, 70/409, 278.2, 351, 278.3, 411, 398, 383
See application file for complete search history.

(56) References Cited

U.S. PATENT DOCUMENTS

| | | | | | |
|---|---|---|---|---|---|
| 3,142,167 | A | * | 7/1964 | Christopher | 70/411 |
| 3,330,141 | A | * | 7/1967 | Greenwald | 70/411 |
| 3,572,070 | A | * | 3/1971 | Brand | 70/411 |
| 3,727,440 | A | * | 4/1973 | Greenwald et al. | 70/411 |
| 4,045,983 | A | * | 9/1977 | Hughes | 70/404 |
| 4,446,709 | A | | 5/1984 | Steinbach | |
| 4,617,813 | A | | 10/1986 | Christopher et al. | |
| 4,622,834 | A | * | 11/1986 | Hughes | 70/395 |
| 4,716,749 | A | | 1/1988 | Johnson | |
| 4,858,456 | A | * | 8/1989 | McGee, Sr. | 70/491 |
| 5,018,376 | A | | 5/1991 | Lee | |
| 5,552,777 | A | | 9/1996 | Gokcebay et al. | |
| 5,745,044 | A | * | 4/1998 | Hyatt et al. | 340/5.23 |
| 6,000,609 | A | | 12/1999 | Gokcebay et al. | |
| 6,082,153 | A | | 7/2000 | Schoell et al. | |
| 6,331,812 | B1 | | 12/2001 | Dawalibi | |
| 6,374,653 | B1 | | 4/2002 | Gokcebay et al. | |
| 6,384,711 | B1 | | 5/2002 | Cregger et al. | |
| 6,474,122 | B2 | | 11/2002 | Davis | |
| 6,550,299 | B1 | * | 4/2003 | Lin | 70/491 |
| 6,552,650 | B1 | | 4/2003 | Gokcebay et al. | |
| 6,615,625 | B2 | | 9/2003 | Davis | |
| 6,826,935 | B2 | | 12/2004 | Gokcebay et al. | |
| 6,895,792 | B2 | * | 5/2005 | Davis | 70/278.3 |
| 7,397,343 | B1 | | 7/2008 | Gokcebay et al. | |
| 7,634,930 | B2 | * | 12/2009 | Boesel et al. | 70/383 |
| 7,694,542 | B2 | | 4/2010 | Loughlin et al. | |
| 7,712,342 | B2 | * | 5/2010 | Loughlin et al. | 70/366 |
| 8,256,254 | B2 | * | 9/2012 | Bellamy | 70/278.7 |
| 2010/0077809 | A1 | | 4/2010 | Gerner et al. | |
| 2010/0139340 | A1 | | 6/2010 | Gerner | |

* cited by examiner

*Primary Examiner* — Daniel Wu
*Assistant Examiner* — Son M Tang
(74) *Attorney, Agent, or Firm* — Michael J. Weins; Jeffrey E. Semprebon

(57) ABSTRACT

A key for opening multiple axial pin locks has a base member with an indexing element and a number of lock pins, configured to match the keyways of the locks. The key has a microprocessor with access to information on the pin configuration for each lock to be opened, and the lock pins are selectively positioned along the base member to match the configuration of a key for a particular lock in response to the user entering an identification code for that lock. The lock pins can slidably engage recessed tracks in the base member, which serve to direct the lock pins parallel to an axis of the base member. A pin latching mechanism can be provided to secure the lock pins in the desired position.

17 Claims, 6 Drawing Sheets

-Prior Art-

-Prior Art-

ELECTRONICALLY-CONFIGURABLE KEY

FIELD OF THE INVENTION

The present invention relates to keys employed with axial pin locks, and more particularly to a single key that can be selectively configured to open a number of such locks without requiring such locks to be modified.

BACKGROUND OF THE INVENTION

Axial pin locks are frequently employed to secure objects such as vending machines to prevent unauthorized access. An axial pin lock provides a simple mechanical lock for securing each machine, resulting in a series of locks for a route of machines; the route attendant servicing the machines is provided with a matching series of keys.

FIG. 1 illustrates one example of a prior art key 10 for opening a tubular axial pin lock (not shown) to obtain access to a locked storage container such as a vending machine to be serviced to collect money and replenish the items to be sold. Examples of such locks where the lock pins are arranged in a circular pattern are taught in U.S. Pat. Nos. 4,716,749 and 5,018,376. The key 10 for such a lock has a hollow base member 12 that is generally cylindrical, and has a key indexing element 14 that is formed by an inwardly-extending tab. The base member 12 is machined to provide an array of grooves 16 having varying depths, each terminating at an activation surface 18 at a specified distance from a front surface 20 at which the groove 16 terminates, the position of the activation surface 18 defining the depth of the groove 16. The base member 12 is affixed to a handle 22.

In use, the base member 12 is aligned with the lock to allow the key indexing element 14 to slidably engage a matching recess in the lock. This alignment serves to properly orient the grooves 16 so as to align them with lock pins (not shown). The base member 12 is then inserted into the lock, bringing each of the activation surfaces 18 into forcible engagement with the corresponding lock pins of the lock. Each of the activation surfaces 18 pushes the lock pin against the pressure of a bias spring to a position corresponding to the depth of the groove 16, the depths of the grooves 16 being milled to bring all the lock pins to a position to form a shear plane to allow rotation of a cylinder of the lock to open the lock.

One alternative configuration for an axial pin lock has the lock pins are arranged in rows, such as taught in U.S. Pat. No. 4,446,709. FIG. 2 illustrates another prior art key 50, which is functionally similar to the key 10 but which is designed for use with an axial pin lock where the lock pins are arranged in a rectangular, rather than circular, configuration. The key 50 again has a base member 52 that is milled to provide an array of grooves 54, each terminating at activation surfaces 56, but does not have a separate indexing element since the rectangular form of the base member 52 can serve to properly align the grooves 54 with the lock pins. For some locks, one of the ends of the rectangle may be modified to provided a contoured end 58 to assure that, when the base member 52 is inserted into the lock, the grooves 54 align with the lock pins.

Locks and keys such as discussed above provide an inexpensive and reasonably secure system for limiting access to a number of locked storage containers. However, this system requires the user to carry a large number of keys, which can be unwieldy if a large number of locks are employed. This problem is exacerbated for service technicians who may need to service machines belonging to more than one service route. Furthermore, this system is susceptible to illicit access by a dishonest keyholder, such as employee theft.

More secure locks can be provided by using any of a variety of lock and key systems that employ smart locks to limit access to the locked containers and a single electronic key which can be programmed to open a number of locks, such as taught in U.S. Pat. Nos. 5,552,777; 5,745,044; 6,082,153; 6,384,711; 6,474,122; 6,552,650; and 6,615,625. These systems can also limit the window of access to a particular vending machine, and can provide a record of the history of which locks have been opened with a particular key and or which keys have been used to open a particular lock; this information can help identify losses due to dishonest key holders. While such systems provide security advantages, the costs of the smart locks are high. This becomes a severe cost burden for uses where a large number of locks must be employed. In the case of vending machine systems, the high cost of purchasing such smart locks is frequently prohibitive for the vendor who distributes goods through routes having a large number of vending machines.

SUMMARY

The smart key described herein overcomes the problem of carrying multiple keys that is currently required for systems which do not employ smart locks. The smart key is designed to operate with conventional axial pin locks, and can be programed to provide many of the advantages of a smart lock systems without requiring existing locks to be replaced with costly smart locks. The axial pin locks for which the smart keys of the present invention are designed to open have an indexing element and n lock pins, n typically being 7 or 8. The smart key herein described relies on having available information on the position of the lock pins for a particular lock to create a shear plane to place the lock in a condition for opening. This information is stored in a key database as well as an associated index based on a lock identifier associated with the lock. This identifier can be provided in a variety of formats, such as an alphanumeric character string, a bar code, or a RFID chip, all of which can be input to the smart key via a lock ID input interface.

The smart key has a base member which in turn has a key indexing element configured to slidably engage the lock indexing element and, in service, is aligned with the axis of the axial pin cylindrical lock. This key indexing element can be a notch or a protrusion axially aligned with a key axis which aligns with the lock indexing element. The base member also has a longitudinal axis.

The key is provided with n directing elements, which extend parallel to each other and to the longitudinal axis of the base member. These directing elements are positioned such that they will align with the n lock pins when the key indexing element is slidably engaged with the lock indexing element. In many preferred embodiments, these directing elements are formed as recessed longitudinal tracks in the base member.

Each of the directing elements is movably engaged by a drive pin such that the drive pin can be longitudinally positioned with respect to the base element, and each drive pin terminates at an activation surface that resides alongside the base member. Thus, the moveable engagement of the n drive pins with their respective directing elements allows the activation surfaces to be longitudinally positioned with respect to the base member. The directing elements are configured such that the activation surfaces of the n drive pins are positioned for engagement with the n lock pins. When the directing elements are formed as recessed tracks, the drive pins can slidably engage the tracks to provide the key with a profile that closely resembles that of a conventional mechanical key.

Means are provided for positioning each of the n drive pins to position each of the activation surfaces at a desired longitudinal location with respect to the base member to provide the proper configuration for the lock to be opened with the key. The means for positioning the n drive pins may depend on the nature of the movable engagement between the directing elements and the drive pins. For example, if the directing elements are provided by threaded passages, the drive pins can be formed as threaded shafts and their position adjusted by motors or servos that selectively rotate the shafts to threadably advance or retract them in the passages to adjust the positions of the activation surfaces. When the directing elements are formed as tracks that are slidably engaged by the drive pins, the sliding action can be powered by a motor or a servo, frequently employed in combination with a linkage mechanism, such as a crank mechanism or rack and pinion mechanism, with or without intermediate gears. The linkage may be either simply by contact or, alternatively, can couple the motor or servo to the drive pins.

A microprocessor is provided for controlling the means for positioning the drive pins so as to adjust the longitudinal positions of the drive pins. The microprocessor is responsive to the lock ID provided via the lock ID input interface.

Using the lock ID, the microprocessor selects information on the correct positions to set each of the drive pins from a key database, which stores the lock pin configurations matched to the lock identifiers. This information is in turn processed by an instruction set that directs the means for positioning the drive pins to move the drive pins to place them each at the appropriate position to allow the lock to be opened.

The nature of the instruction set depends of the details of the means for positioning the drive pins. Where a single axial positioning means is used to position all n pins, the instruction set activates a rotational (or translational) mechanism to rotate (translate) the axial positioning means and associated linkage substantially within a plane normal to the key axis to align the axial positioning means with a particular drive pin such that the appropriate pin can be driven by the axial positioning means to place that drive pin at the desired position. This process is repeated until all the drive pins have been positioned at the appropriate locations. In this case, since the drive pins are individually positioned and are not constrained except when being positioned by the axial positioning means, a pin latching mechanism is provided to assure that the drive pins are not repositioned as the key is inserted into the lock. Such a pin latching mechanism can also be advantageous in keys where each of the drive pins are positioned by individual dedicated positioning mechanism. Since the drive pins in a system employing a single positioning mechanism cannot be readily mechanically coupled to the axial positioning means, a pin reset device is provided to place the pins in a reference position before the pins can be set.

When multiple axial positioning means are employed and provide a dedicated axial positioner for each drive pin, such a system can reduce the complexity of the means for positioning the n drive pins by eliminating the need to rotate (translate) an axial positioning means about the key axis. Since there is no rotary/translational motion of the axial positioning means, this scheme also allows coupling linkage between the motor or servo and the drive pins, and may eliminate the need for pin reset mechanism. While the spacing between the drive pins may not be sufficient to accommodate the number of individual axial positioning devices needed, the coupling linkages can each be configured to provide an offset to allow sufficient spacing to accommodate these devices while maintaining a smaller separation between the drive pins. The linkage can also be configured to provide a reduction in displacement, facilitating precise positioning of the associated drive pin.

Since the key has an on-board microprocessor, it is possible for the microprocessor to be programmed so that it can perform many of the functions provided by systems that employ smart locks, such as limiting access to particular locks based on time, limiting the number of times a lock can be accessed before requiring reauthorization, creating a history of locks opened with the particular key, etc.

BRIEF DESCRIPTION OF THE FIGURES

FIG. 1 illustrates a key for a tubular lock, having a number of pins in a radial array, while FIG. 2 illustrates a key for a lock having a rectangular arrangement of pins. In either case, the key has a base member with an indexing element (in FIG. 1, the indexing element is a tab extending into a central recess, while in FIG. 2 the base member itself serves to index the key) with an array of grooves which each extend a particular length along the key before terminating at an activation surface. When the key is indexed with the lock and inserted, each of the activation surfaces engages one of the pins of the lock and moves the pin the correct distance to provide a shear line to allow rotating a cylinder of the lock to open the locked device.

FIG. 5 also illustrates a pin latch mechanism that retains the drive pins in position once all have been moved to their correct positions by the pin-driving servo. A pin-securing collar surrounds the base member and has notches to accommodate the drive pins. The pin-securing collar has a split section that can be tightened by a locking actuator; when the locking actuator is activated, the pin-securing collar is tightened to clamp the drive pins against the base member to secure each of the drive pins at its current position along the associated track.

DETAILED DESCRIPTION

Figure 1:
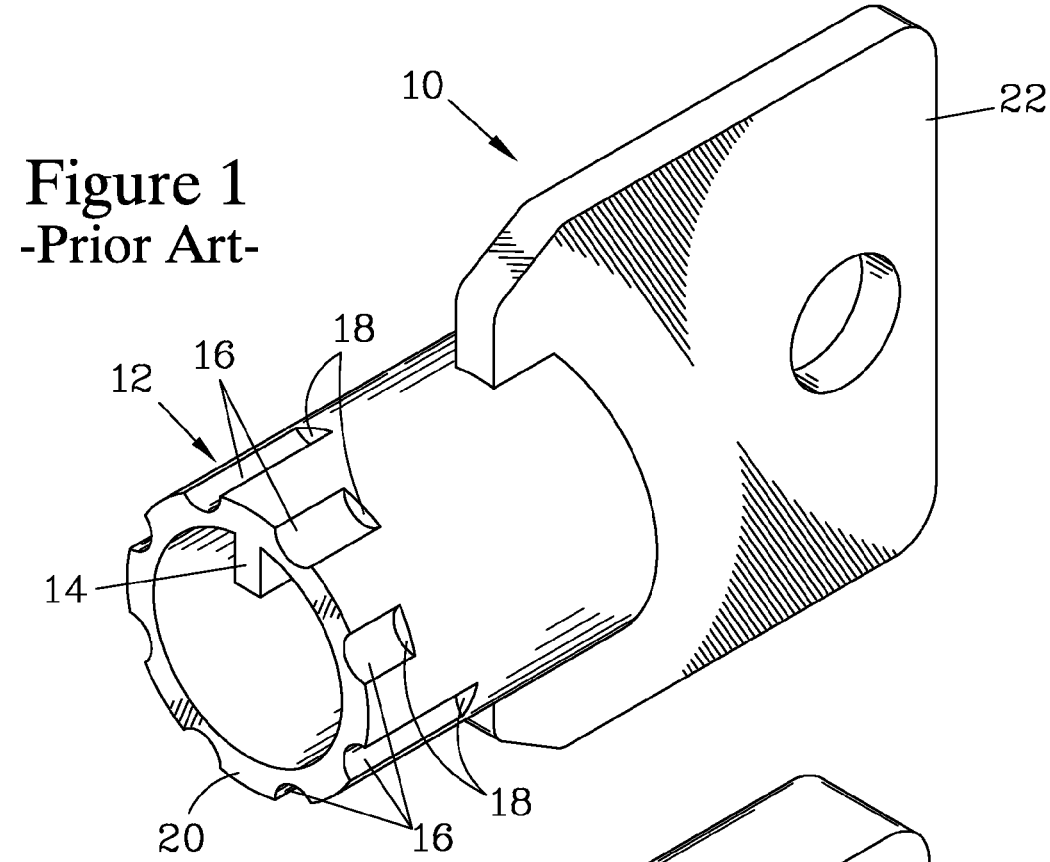
FIGS. 1 and 2 illustrate prior art keys used for two different types of axial pin tumbler locks.
Figure 3:
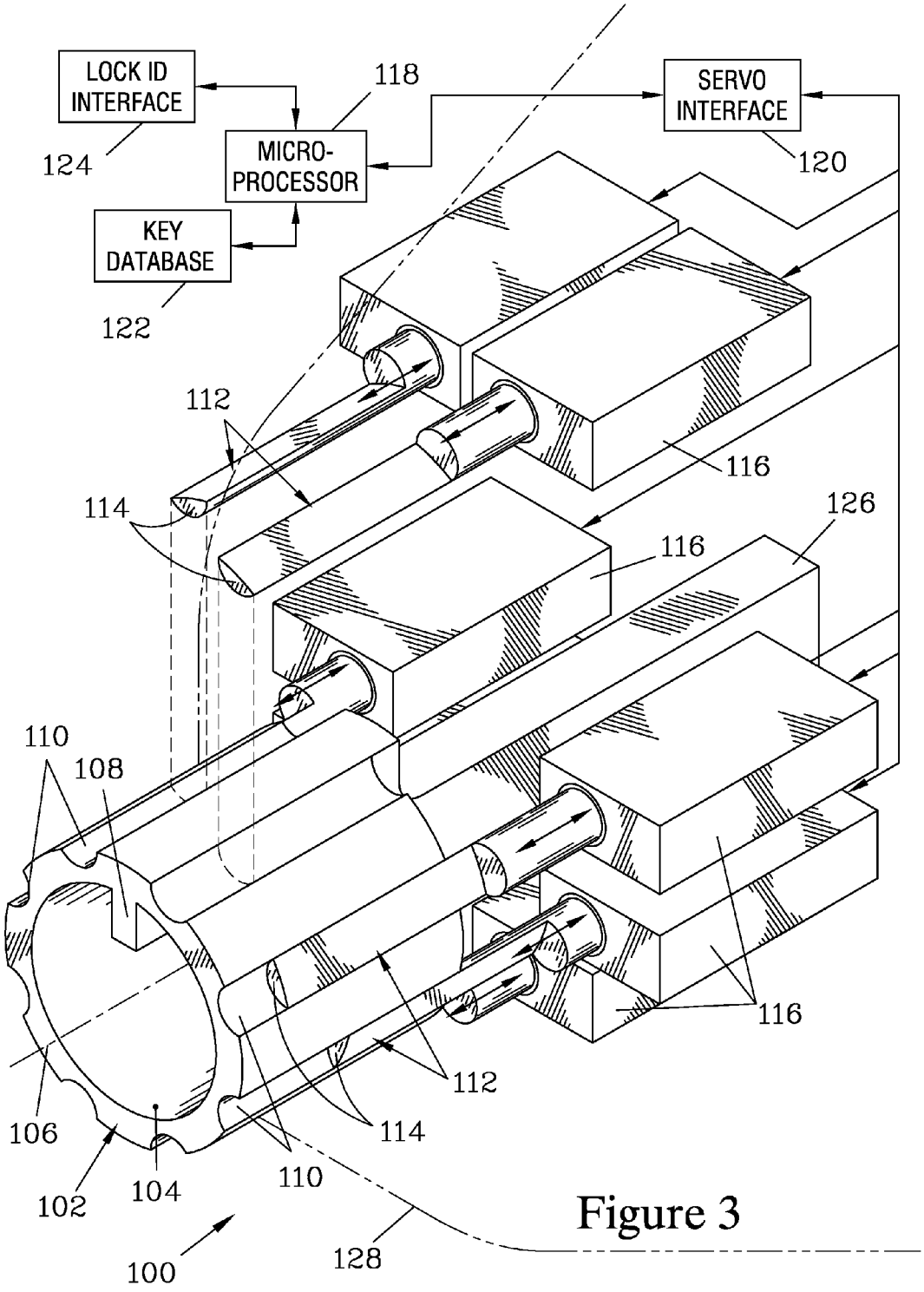
FIG. 3 is a partially exploded isometric view illustrating the functional elements of an electronically-configurable key of the present invention designed to replace a number of tubular keys such as that shown in FIG. 1. The key has a base member with a key indexing element, which slidably engages a lock indexing element (not shown), and an array of longitudinal tracks that serve as directing elements, each slidably engaged by a drive pin. Each of the drive pins terminates at an activation surface and can be slid along the track by a servo to position the activation surface so as to provide the effect of a groove of desired depth. A microprocessor communicates with a lock ID input interface and, based on the input from the lock ID input interface, makes the appropriate selection from a key database to match the pin configuration for the lock to be opened. The microprocessor then instructs the servos, via a servo interface, to move the drive pins to the correct positions for that lock, providing a configuration that matches the appropriate prior art key for that lock.

FIG. 3 is a partially-exploded isometric view of a key 100 that forms one embodiment of the present invention. The key 100 can be configured to provide the same function as the prior art key 10 discussed above and shown in FIG. 1, as well as being configured to match the configurations of other, similar keys in order to open other conventional locks without requiring modification or replacement of such locks. Allowing the key 100 to be re-configured to match the pin configuration of other locks allows a user to open a number of locked objects with a single key 100. The key 100 can, in some embodiments, optionally perform additional security features.

The key 100 has a base member 102 that is substantially cylindrical, defining an open central region 104, both the base member 102 and the central region 104 being symmetrically disposed about a central axis 106. The base member 102 has an indexing tab 108 that, in this embodiment, extends into the central region 104 and is configured to provide the same alignment function as the key indexing element 14 of the key 10. The base member 102 also has an array of longitudinal tracks 110 that provide directing elements for the key 100. The tracks 110 are recessed into the base member 102 and which extend parallel to the central axis 106. These tracks 110 are so positioned with respect the indexing element 108 such that, when the indexing tab 108 is slidably engaged in an indexing slot (not shown) of the lock, the tracks 110 are aligned with the lock pins of the lock (not shown).

Each of the tracks 110 is slidably engaged by a drive pin 112 that terminates at an activation surface 114 residing alongside the base member 102. Each of the drive pins 112 is positioned along the associated track 110 by a dedicated pin-positioning servo 116 in order to place the activation surface 114 at a desired location along the track 110. In combination, the track 110 and the activation surface 114, when positioned correctly, provide the same function as one of the grooves 16 of the key 10, with the effective depth of the resulting groove determined by the position of the activation surface 114. In the key 100 illustrated, the drive pins 112 are formed as simple shafts that can be extended or retracted by the servos 116. For the dimensions needed to use the key 100 with conventional locks, there may not be adequate space to accommodate the necessary number of servos 116 when connected to the pins 112 in such a manner, in which case alternative connections can be employed to overcome such spacing problems; examples of such connections are discussed below with regard to FIGS. 4, 6, and 7.

The pin-positioning servos 116 are controlled by a microprocessor 118 through a servo interface 120. The microprocessor 118 instructs the servos 116 to extend or retract the drive pins 112 in order to place the activation surfaces 114 at the proper locations for opening the particular lock to be opened. Since the key 100 is designed for use with multiple locks, it is provided with a key database 122 that contains information on the drive pin positions needed for all the locks that the key 100 is intended to open, at least before being reprogrammed. As discussed in greater detail below with regard to FIG. 8, the key 100 can be designed to allow this information to be updated to change the locks to which the key 100 has access, as well as to provide additional security features. To limit risk in the event that the key 100 is lost or stolen, it is frequently preferred for the key database 122 to be provided only the information for a limited number of locks to be opened on a particular route and for this information to be erased and reprogrammed daily.

To select the appropriate set of pin positions for the particular lock to be opened, an identifier for the lock must be provided. The key 100 has a lock ID interface 124 that allows the user to enter a lock identifier to allow the microprocessor 118 to select the proper set of pin positions from the key database 122. In a simple scheme, the lock identifier can be a numerical identifier, in which case the lock ID interface 124 can be provided by a keypad that allows the user to manually enter the ID number. Greater accuracy and ease of use can be provided by using an electronically-readable tag as the lock identifier; such can be provided by a bar code presented on the locked object, by placing an RFID chip on the locked object, or by otherwise providing a tag on the lock or the locked object. When the lock identifier is an electronically-readable tag, the lock ID interface 124 is a scanner appropriate for reading the tag, and the user enters the lock ID by placing or positioning the key 100 in the proper location and orientation for the scanner to read the tag. It is preferred that an audible and/or visual notice is provided to the user when the identifier has been scanned. In any case, once the lock identifier is provided to the microprocessor 118, the microprocessor 118 can operate according to programmed instructions to match the identifier with the appropriate set of pin positions in the key database 122 for that lock and then, via the servo interface 120, direct the servos 116 to extend or retract the shafts that provide the drive pins 112 so as to place the activation surfaces 114 at the proper positions along the tracks 110 to configure the key 100 to open that lock.

Since the key 100 has a microprocessor 118, the key 100 can handle other logical functions and can be programmed so that it can perform many of the functions commonly performed by smart locks. For example, the instruction set employed by the microprocessor 118 can be designed to provide additional security features to allow operation of the servos 116 only under specified conditions, as discussed below with regard to FIG. 8.

Figure 8:
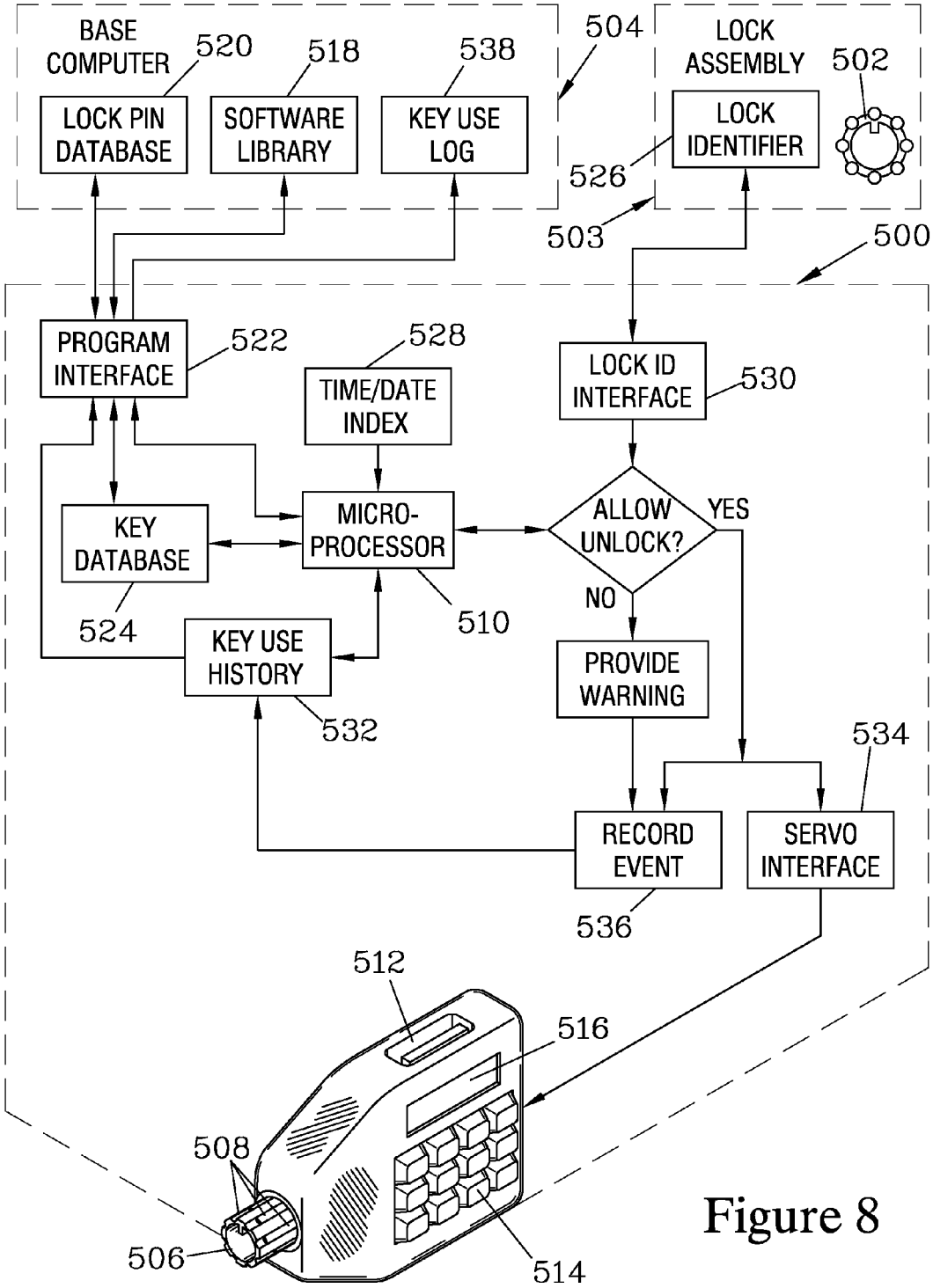
FIG. 8 is a schematic representation of a smart key having a microprocessor that tracks the time-dependent use of the key and does so in response to an instruction set provided by a base computer which can manage keys employed to open locks on multiple routes.

To allow the key 100 to turn the lock cylinder once the lock pins have been moved to create a shear plane, the base member 102 is affixed to a key shank 126 that in turn is secured to a key housing 128 (partially shown in phantom; a similar housing for a key is shown in FIG. 8) that can be readily grasped and rotated by the user. The engagement of the indexing tab 104 and the tracks 110 with corresponding structure of the lock allows the base member 102 to apply torque to the lock cylinder as the key shank 126 is rotated.

Figure 2:
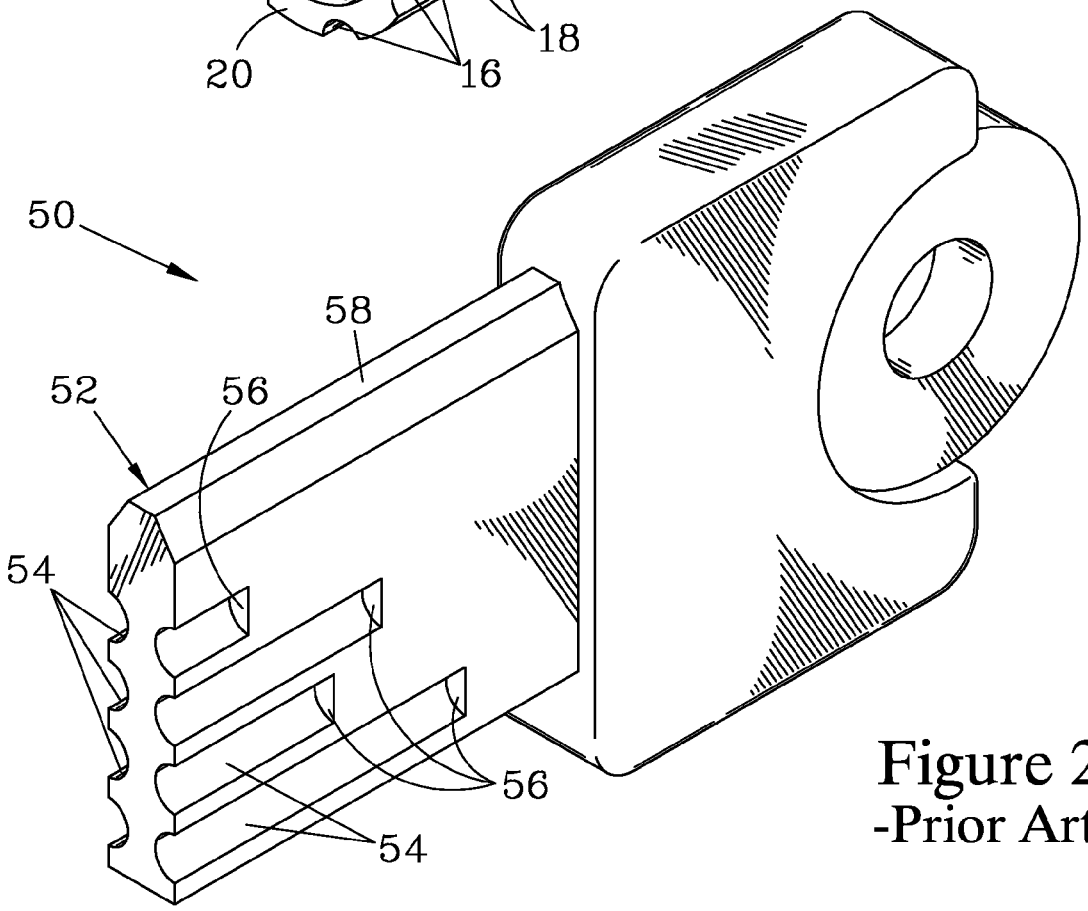
Figure 4:
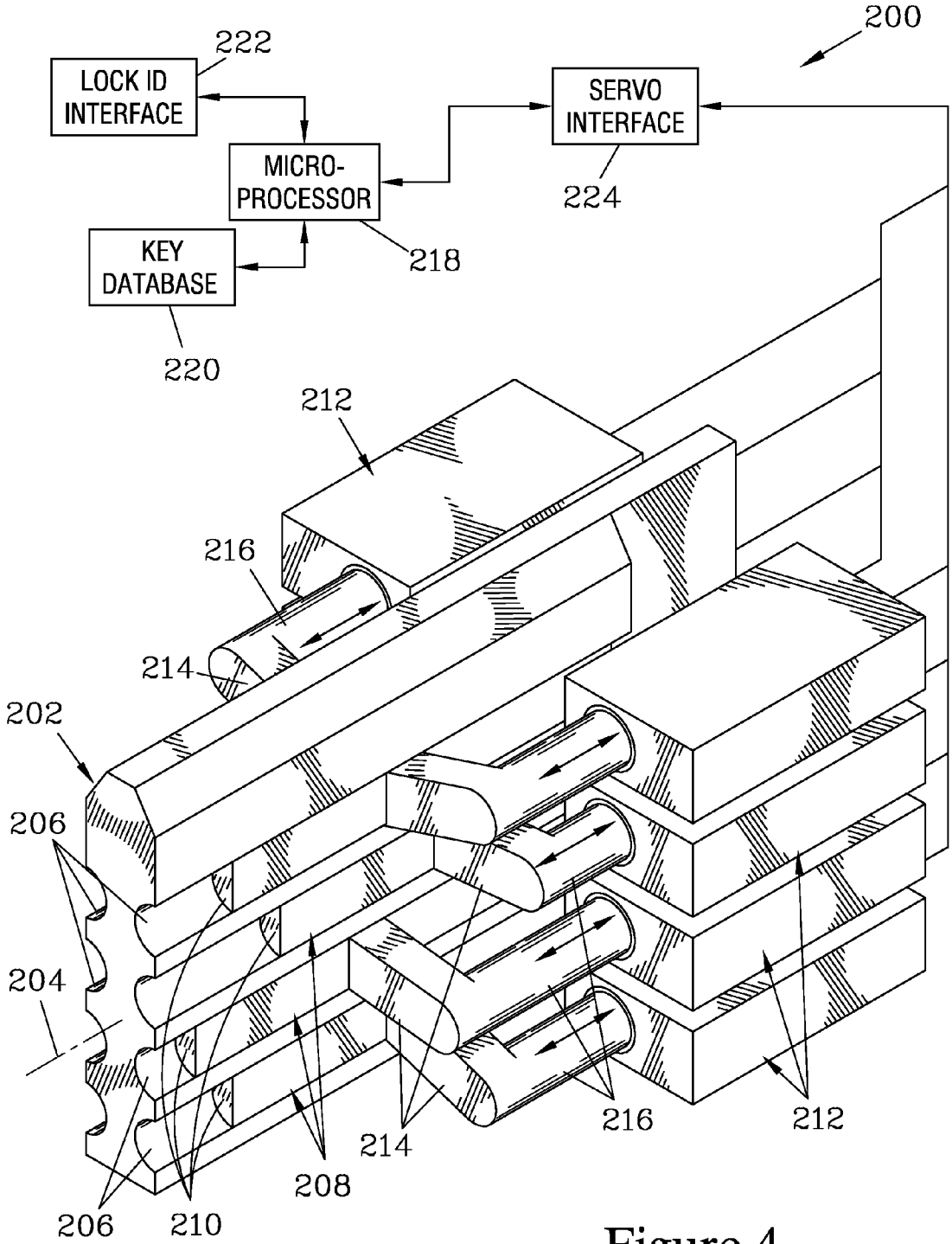
FIG. 4 is an isometric view illustrating the functional elements of a key of the present invention designed to replace a number of rectangular keys such as that shown in FIG. 2. The key functions similarly to the key shown in FIG. 3. However, in this embodiment, the spacing of the drive pins is not sufficient to accommodate placing each of the servos in alignment with its associated pin. To provide sufficient space for placement of the servos, each servo is connected to its associated pin by an offset leg. However, the drive pins are again directly coupled to the servos in this embodiment.

FIG. 4 is a partial isometric view of a key 200 that forms another embodiment of the present invention, and which is designed to provide the function of a number of conventional keys having a rectangular arrangement of grooves, such as the key 50 shown in FIG. 2. The key 200 has a base member 202 that is substantially rectangular, but which has asymmetric ends so as to assure that the user directs the key 200 into the lock in the proper orientation. Since the base member 202 serves to orient the key 200, no separate key indexing element is required. The base member 202 extends along a longitudinal axis 204 and has a rectangular array of tracks 206 formed as recesses in the base member 202; the tracks 206 extend parallel to the axis 204.

Each of the tracks 206 is slidably engaged by a drive pin 208 terminating at an activation surface 210, the drive pin 208 being positioned along the track 206 by a pin-positioning servo 212. Again, the position of each of the drive pins 208 along its associated track 206 serves to place the activation surface 210 at position where the track 206 and the activation surface 210, in combination, provide the correct effective depth as one of the grooves 54 of the key 50.

In the key 200 illustrated, the servos 212 are too large to be positioned in direct alignment with the drive pins 208. To provide increased spacing to accommodate the servos 212, the drive pins 208 are each connected to the associated servo 212 by an offset leg 214 that is affixed at one end to the drive pin 208 and at the other end to a servo shaft 216 that is extended or retracted by the servo 212. By angling the offset legs 214, the servos 212 can be positioned with a greater spacing than the spacing between the adjacent tracks 206.

The servos 212 are again controlled by a microprocessor 218, operating in conjunction with a key database 220, containing the pin positions for the locks to be opened by the key 200, and a lock ID interface 222, which allows the operator to enter an identifier for the particular lock to be opened at the current time. The function of these elements and a servo interface 224 can be the same as that of the equivalent elements of the key 100 discussed above.

Figure 5:
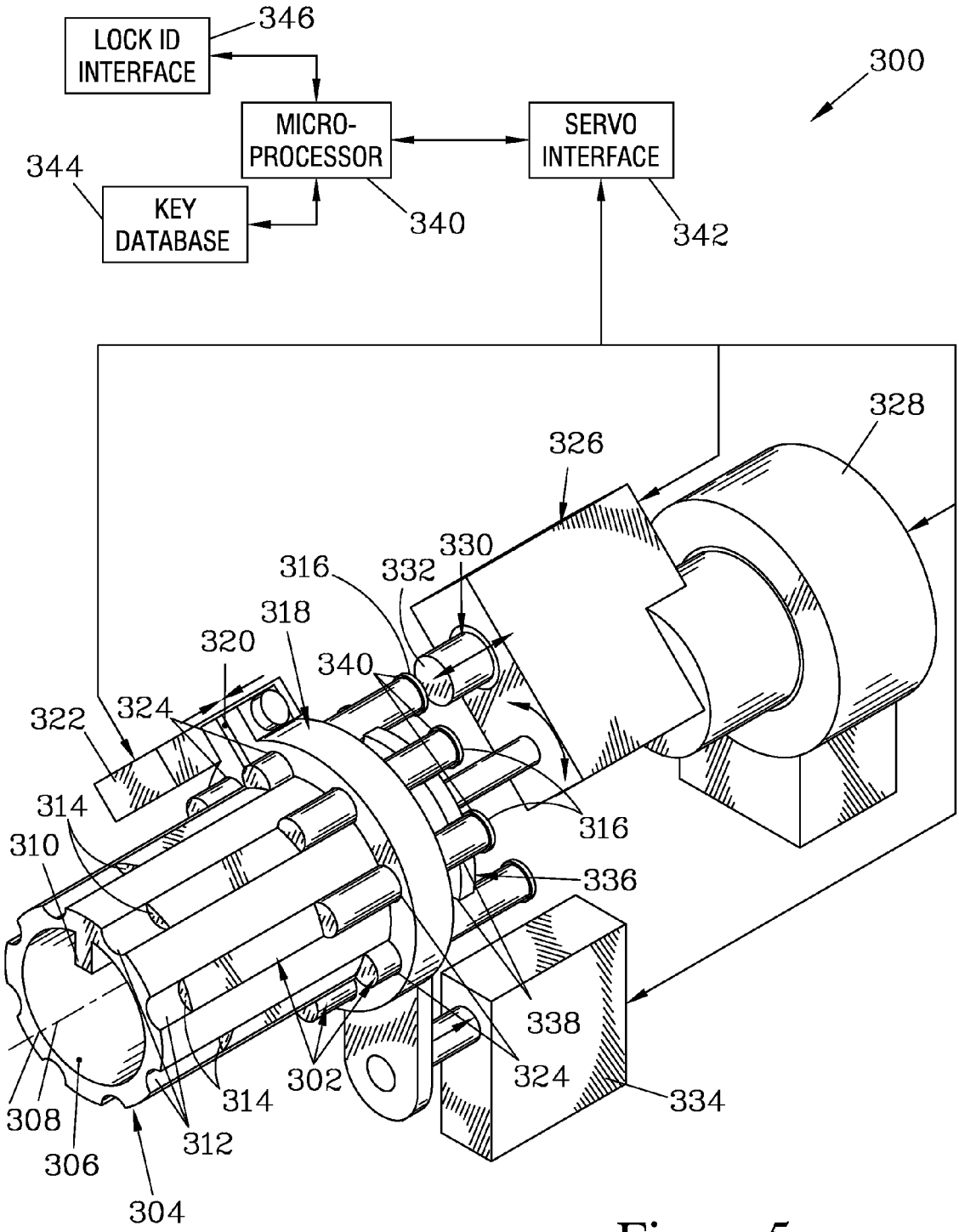
FIG. 5 is an isometric view of a key of the present invention which provides a function similar to that of the key shown in FIG. 3, but which employs a single means for axially positioning the drive pins along their tracks. The means for axial positioning (pin-driving servo) is rotatably mounted with respect to the base member of the key and can be rotated into alignment with any of the drive pins by a positioning driver. This embodiment also differs in that there is no coupling for attaching the pin-drive servo to the drive pins. To return the drive pins to a reference position after an unlocking operation, a reset actuator is activated to move a reset plate that engages a flange on each of the drive pins to move the drive pins back to a reference position.

FIG. 5 is an isometric view of a portion of a key 300 that provides a function similar to that of the key 100 discussed above, but which employs an alternative means for positioning an array of drive pins 302. The key 300 again has a base member 304 that forms a cylinder having an open central region 306 and a central axis 308. The base member 304 has an indexing tab 310 and an array of recessed longitudinal tracks 312 that extend parallel to the central axis 308. The tracks 312 are each slidably engaged by one of the drive pins 302

In the key 300, each of the drive pins 302 terminates at an activation surface 314 at one end and a servo-engaging surface 316 at the other. The drive pins 302 are retained in engagement with the tracks 312 by a pin-securing collar 318 that encircles the base member 304 and the drive pins 302. The pin-securing collar 318 can also serve as a pin latching mechanism to immobilize the drive pins 302 with respect to the tracks 312; the pin-securing collar 318 has a split region 320 that can be tightened by a collar servo 322. The pin-securing collar 318 has an array of collar notches 324 that are configured to slidably engage the drive pins 302 when the pin-securing collar 318 is loose, but which forcibly clamp the drive pins 302 when the collar servo 322 is activated to tighten the split region 320. When so tightened, the collar notches 324 apply a radially-inward force on the drive pins 302, clamping them in place in the tracks 312.

When the pin-securing collar 318 is loose, the drive pins 302 can be moved to the desired positions along their tracks 312 by a pin actuator 326. In the key 300, a single pin actuator 326 is employed, and acts to sequentially move each drive pin 302 individually into the desired position. The pin actuator 326 is mounted with respect to the base member 304 so as to rotate about the central axis 308. An actuator-positioning servo 328 rotates the pin actuator 326 to bring it sequentially into alignment with each of the drive pins 302. When the pin actuator 326 is aligned with one of the drive pins 302, it is positioned such that an extendable and retractable actuator shaft 330 having an actuator pushing surface 332 is axially aligned with the drive pin 302. In this position, extending the actuator shaft 330 brings the actuator pushing surface 332 into engagement with the servo-engaging surface 316 of the drive pin 302, allowing the actuator shaft 330 to push the drive pin 302 along the track 312 until the activation surface 314 of the drive pin 302 is at the desired position. Preferably, when the pin-securing collar 318 is loose, the friction between the pins 302 and the tracks 312 in combination with a small amount of clamping force applied by the pin-securing collar 318 maintains sufficient frictional resistance to maintain the drive pins 302 in place once positioned.

After pushing the drive pin 302 to the correct position, the actuator shaft 330 is retracted and the actuator positioning servo 328 rotates the pin actuator 326 to place the actuator shaft 330 into alignment with the next drive pin 302 to be positioned. After all the drive pins 302 have been so positioned, the collar servo 322 is activated to tighten the pin-securing collar 318 to lock the drive pins 302 into position, allowing them to apply force against lock pins when the key 300 is employed to open a lock.

It should be appreciated that a mechanism for latching the pins, such as the pin-securing collar 318 employed in this embodiment, could also be employed in keys where each drive pin is positioned by a dedicated servo, such as the keys 100 and 200 discussed above, in order to positively secure the drive pins in position as the key is employed to open a lock and thereby avoid undue stress and wear on the pin-positioning servos.

Since the pin-actuator 326 of this embodiment can only push the drive pins 302 forward along their tracks 312, a reset mechanism is required to return the drive pins 302 to an initial reference position after the key has been used to open a lock. Such reference position serves as a starting point from which the drive pins 302 can be advanced to the desired positions to configure the key 300 to open a subsequent lock. A reset actuator 334 is provided, which acts to move a reset plate 336. The reset plate 336 has an array of plate notches 338 that are configured to slidably engage the drive pins 302, but which allow the reset plate 336 to forcibly engage a reset flange 340 on each of the drive pins 302. When the reset actuator 334 is activated (at which time the pin-securing collar 318 must be loose), it moves the reset plate 336 axially towards the pin actuator 326, causing the reset plate 336 to engage the reset flanges 340 of the drive pins 302 to move the drive pins 302 to a reference position, from which they can subsequently be advanced by the pin-actuator 326 in order to configure the key 300 to open the next lock.

The collar servo 322, the pin actuator 326, the actuator-positioning servo 328, and the reset actuator 334 are operated in coordination by a microprocessor 340 via a servo interface 342 to place the drive pins 302 in the proper positions according to a set of pin positions retrieved by the microprocessor 340 from a key database 344 in response to a lock identifier that is input by the user through a lock ID interface 346.

As noted above with regard to the key 200 shown in FIG. 4, in some cases where a dedicated servo is provided for each of the drive pins, there may not be sufficient room for the servos to be positioned in alignment with the drive pins, requiring some connection between the drive pins and the servos that provides an offset. In some cases, it is also difficult to obtain servos which provide the necessary degree of accuracy in positioning to locate the drive pins along the tracks with sufficient precision to match the variation in groove depth found in conventional keys. Two examples of structures for connecting a drive pin to a servo that can overcome these problems are discussed below and illustrated in FIGS. 6 and 7.

Figure 6:
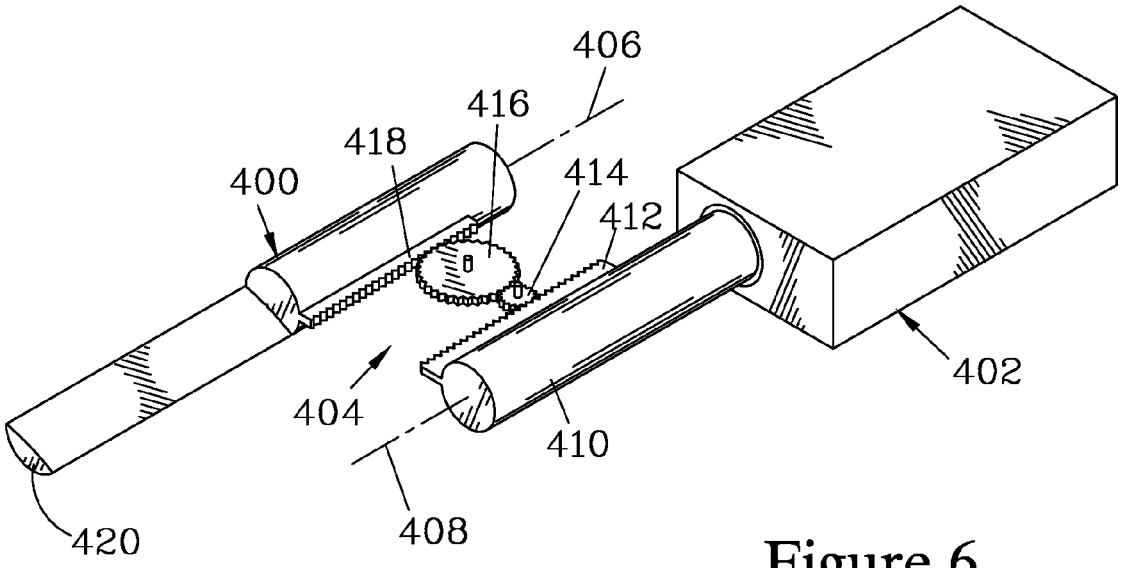
FIG. 6 is an isometric view illustrating one example of a gear-reduction mechanism that can be employed to connect a pin-driving actuator with a drive pin in a key of the present invention. The gear-reduction mechanism serves both to reduce the resulting displacement, thereby allowing finer control of the position of the drive pin, as well as providing an offset to help accommodate pin-driving actuators that are too large to be positioned in-line with the drive pins. This mechanism also assures direct coupling between the servo and the drive pin, thereby eliminating the need for a reset mechanism.

FIG. 6 is an isometric view showing a drive pin 400 and a servo 402 that are connected by a gear reduction mechanism 404 that not only provides more precise control of the axial position of the drive pin 400, but also provides an offset between a pin axis 406 of the drive pin 400 and a servo axis 408 of the servo 402.

The servo 402 has an actuator shaft 410 which can be extended and retracted. The gear reduction mechanism 404 has a drive rack 412 that extends along a portion of the actuator shaft 410. The mechanism 404 also has a drive gear 414 that engages the drive rack 412 such that the drive gear 414 is turned by the translational motion of the drive rack 412 as the actuator shaft 410 is extended or retracted.

The gear reduction mechanism 404 also has a pin gear 416 that engages the drive gear 414 as well as a pin rack 418 that is affixed to the drive pin 400. As the drive gear 414 is rotated by motion of the drive rack 412, it in turn rotates the pin gear 416 which causes translation of the pin rack 418, which extends along a portion of the drive pin 400. The translation of the pin rack 418 moves the drive pin 400 along a track (not shown) to place an activation surface 420 of the drive pin 400 at a desired location. Because the drive gear 414 is smaller than the pin gear 416, each complete rotation of the drive gear 414 only causes a partial rotation of the pin gear 416, and thus the translation of the pin rack 418 is only a fraction of the translation of the drive rack 412. Since the magnitude of the translation of the drive pin 400 is a fraction of that of the actuator shaft 410, the precision in positioning the activation surface 420 is accordingly greater than the precision in positioning the actuating shaft 410, reducing the need for a high degree of precision in the servo 402.

Figure 7:
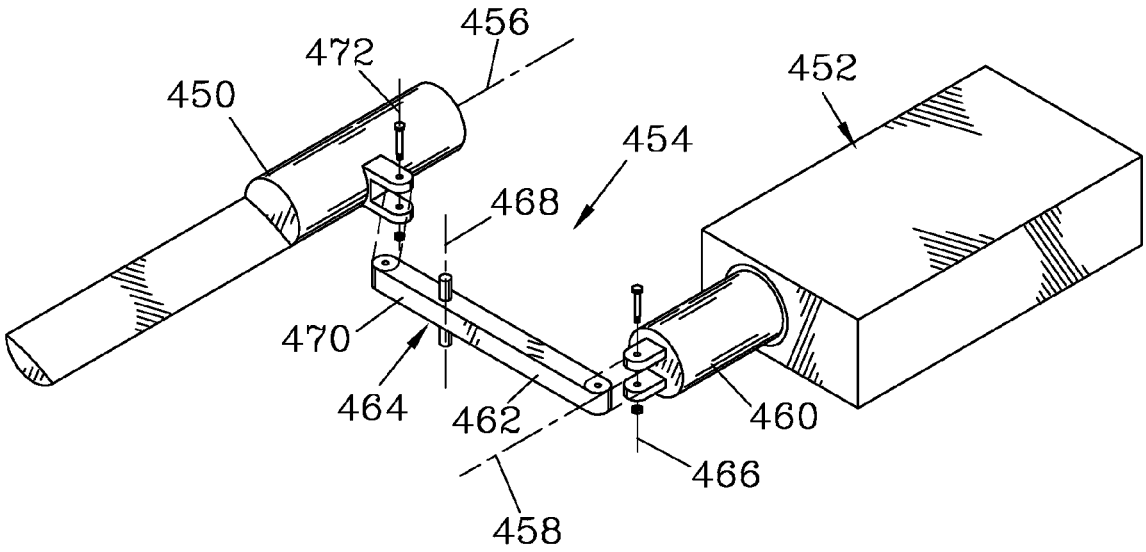
FIG. 7 is an isometric view illustrating a lever arm connection that can be employed to connect a pin-driving actuator with a drive pin to reduce displacement and provide an offset. Again, this connection also assures direct coupling between the servo and the drive pin, thereby eliminating the need for a reset mechanism.

FIG. 7 is an isometric view of a drive pin 450 and a servo 452 that are connected by a lever reduction mechanism 454. The lever reduction mechanism 454 again provides more precise control of the axial position of the drive pin 450, as well as providing an offset between a pin axis 456 of the drive pin 450 and a servo axis 458 of the servo 452 to better accommodate placement of a number of servos 452 in a housing (not shown) of a key.

The servo 452 has an actuator shaft 460 which can be extended and retracted. The actuator shaft 460 is pivotably connected to a long leg 462 of a pivotably-mounted lever member 464, so as to allow pivotal motion therebetween about a first pivot axis 466. The lever member 464 itself pivots about a lever pivot axis 468 that is parallel to and spaced apart from the first pivot axis 466. The lever member 464 also has a short leg 470 that is pivotably connected to the drive pin 450 so as to allow pivotal motion therebetween about a second pivot axis 472; it should be appreciated by one skilled in the art that the pivotal connections should be configured to provide some degree of freedom to prevent binding. The second pivot axis 472 is parallel to the lever pivot axis 468, and spaced apart therefrom by a distance significantly less than the distance between the lever axis 468 and the first pivot axis 466. Because of this difference in distance, translational motion of the actuator shaft 460 causes a rotation of the lever member 464 about the lever axis 468 that results in a smaller amount of translation of the drive pin 450.

FIG. 8 schematically illustrates a key 500 for use opening a number of locks 502 which are each part of a lock assembly 503 (only one of which is shown). Typically, such a key 500 may be used when servicing a route of vending machines. In such situations, the key 500 can be programed to schedule the route for a driver and limit access to the machines. The key 500 operates in conjunction with a base computer 504 which can serve a number of such keys 500 and can be programmed to accommodate instructions and data needed for a number of routes.

The key 500 has a base member 506 and an array of pins 508 which can be slidably engaged with the lock 502. The pins 508 in turn can be configured by an on-board microprocessor 510 of the key 500 to match the configuration of a physical key for opening the lock 502; the configuration of the pins 508 can be established by any of the schemes discussed above. As illustrated, the key 500 has a data-connection port 512, which allows the microprocessor 510 to be connected to the base computer 504, and a keypad 514 which allows the user to input data and/or instructions to the microprocessor 510. A display 516 provides information from the microprocessor 510 to the user.

The base computer 504 illustrated includes a software library 518, for storing instruction sets that can be downloaded to the microprocessor 510 to provide the desired operation of the key 500. The base computer 504 also has a lock pin database 520 that contains records of the pin configurations for all the locks 502 intended to be opened by the key 500. The lock pin database 520 can also contain additional data, such as information on the physical location of each lock 502 so that the data can be indexed to list all the locks 502 on a particular route and/or any other data associated with the particular locks 502 that may be needed to provide the desired control of access by the user of the key 500.

The key 500 is connected to the base computer 504 by a program interface 522, such as can be provided by the data-connection port 512 shown in FIG. 8. It should be appreciated that other means known in the art for connecting a remote device to a computer, such as wireless communication, could be employed. The program interface 522, when in communication with the base computer 504, allows instruction sets from the software library 518 be downloaded to the microprocessor 510, and allows a subset of the lock data in the lock pin database 520 to be downloaded into a key database 524. At a minimum, this data includes the correct configuration of the array of pins 508 for each lock 502 to be opened, indexed by a lock identifier 526 which is included as part of each of the lock assembles 503. For enhanced security in the event that the key 500 is lost or stolen, it is frequently preferred to only download information for a limited number of locks 502 to the key database 524. As pointed out above, additional information on the lock 502 can be included to enhance the security provided by the key 500 against unauthorized use. Once the desired information has been downloaded from the base computer 504 to the key 500, the key 500 is ready for use and can be disconnected from the base computer 504.

The key 500 includes a date/time index 528 that provides the current date and time to the microprocessor 510. This information can be used by the instruction sets stored in the microprocessor 510 to control access to the lock pin configurations stored in the key database 524. One basic security function is to block access to this data after a set time, effectively deactivating the key 500 after a period of time corresponding to the maximum time expected for the user to complete the route for that day, preventing unauthorized use in the event that the key 500 is lost or stolen. Access to the data can be resumed when the key 500 is again connected to the base computer 504, or the data can be erased from the key database 524 after a specified period of time and reloaded when the key 500 is again connected to the base computer 504. Additional time-based access limitations can be implemented on an individual basis for each lock 502, as discussed below.

When the user is at the location of a particular lock 502, the user enters the lock identifier 526 for that lock 502 via a lock ID interface 530. When the lock identifier 526 is a numeric code, it could be manually entered by the user via the keypad 514, which serves as the lock ID interface 530 in such case. However, to simplify use and reduce the likelihood of operator error, it is preferable for the lock identifier 526 to be an electronically readable tag such as a bar code or RFID chip, in which case the lock ID interface 530 is an appropriate scanner for reading the tag. A notice that the tag has successfully been read can be shown on the display 516, and/or could be provided by an audible notice such as a chime (not shown). The microprocessor 510 is programmed to make a decision as to whether or not access to the particular lock 502 should be granted. In a simple scheme, this decision can be made based on whether or not the lock identifier 526 matches an accessible pin configuration stored in the key database 524. However, more sophisticated control can be provided by determining whether the lock 502 should be opened based on the current time and date as indicated by the time/date index 528 and/or based on information stored in a key use history 532 that maintains a record of the unlocking operations performed by the key 500. The use of the key 500 for a particular lock 502 could be limited to access within a specified window of time. One typical example is for the key 500 to prevent access to the same lock 502 within a set time of when it has previously been opened by the key 500.

If the microprocessor decides that access to the lock 502 should be granted, it obtains the correct pin configuration from the key database 524 to match the lock identifier 526, and operates the array of pins 508 via a servo interface 534 to configure the array of pins 508 to match the appropriate mechanical key for opening the lock 502. Notice that the key 500 has been configured can be provided on the display 516, and/or an audio signal can be provided. The microprocessor 510 also makes a record 536 of the unlocking operation for storage in the key use history 532. In the event that the microprocessor 510 decides that access to the lock 502 should not be granted, a warning of such can be provided to the user via the display 516. A record 536 of the unsuccessful attempt should also be stored in the key use history 532. The key use history 532 is uploaded to the base computer 504 via the program interface 522 the next time that the key 500 is connected to the base computer 504, providing a key use log 538 of the operations conducted by the key 500 over time.

When the lock identifier 526 is provided by a RFID tag, a writable RFID tag can be employed, in which case the key 500 is configured to write a record of the unlocking operation onto the RFID tag. This provides a record of the unlocking operation even in the event that the key 500 is subsequently lost or stolen.

What I claimed is:

1. A smart key for opening a number of selected axial pin cylinder locks, each of the locks having n lock pins, a lock identifier and a corresponding configuration of lock pin positions indexed with respect to a lock indexing element, the key comprising:

a base member having a key indexing element configured to slidably engage the lock indexing element of the lock and a longitudinal axis;

n directing elements extending parallel to each other and to said longitudinal axis of said base member;

n drive pins, each moveably engaged in one of said directing elements so as to be longitudinally positionable with respect to said base member and terminating at an activating surface located alongside said base member;

means for positioning each of said n drive pins so as to place each of said activating surfaces at a desired longitudinal location with respect to said base member;

a microprocessor controlling operation of said means for positioning said drive pins to adjust the location of each of said activating surfaces with respect to said base member;

a key database accessible by said microprocessor for storing the configurations of lock pins and matched lock identifiers for the selected locks to be serviced;

a lock ID input interface for providing to the microprocessor the lock identifier for a current lock to be opened, an instruction set responsive to the input from said a lock ID input interface and interactive with said key database, said instruction set controlling the motion of said means for positioning said drive pins thereby placing each of said drive pins at the correct position according to the lock pin configuration that matches the selected lock identifier so as to place each of said activating surfaces at the locations where rotation can occur when the key is inserted into the selected lock.

2. The key of claim 1 wherein said directing elements are provided by an array of longitudinal tracks recessed into in said base element, and further wherein said drive pins slidably engage said tracks.

3. The key of claim 2 further comprising:

a pin latching mechanism which can be activated to block said pins from moving with respect to said base member once said pins have been moved to their correct positions to match the lock pin configuration for the selected lock.

4. The key of claim 3 for use with a base computer containing a master database of lock identifiers and corresponding lock pin configurations, the key further comprising:

an information transfer port for providing information exchange between said microprocessor and said base computer; and further wherein said microprocessor has an associated read-write memory for storage of said key database which can be accessed by said information transfer port.

5. The key of claim 4 wherein the information transferred also includes at least one instruction set to regulate the use of the key.

6. The key of claim 2 wherein said means for positioning said drive pins further comprises:

a pin actuator mounted so as to be movable to a selected one of n positions where it is positioned to cause translation of an associated one of said n drive pins;

at least one actuator-positioning driver that is operated by said instruction set to move said pin actuator to each of said n positions, whereby, when said pin actuator is in each of said n positions, it can be operated to move the one of said n drive pins associated with that position to the correct position for that drive pin to match the lock pin configuration for the selected lock; and a pin latching mechanism which can be activated to block said pins from translating once said pins have been moved to their correct positions to match the lock pin configuration for the selected lock.

7. The key of claim 6 further comprising:

a reset actuator that can be operated to move said n drive pins to a specified reference position.

8. The key of claim 2 for use with a base computer containing a master database of lock identifiers and corresponding lock pin configurations, the key further comprising:

an information transfer port for providing information exchange between said microprocessor and said base computer; and further wherein said microprocessor has an associated read-write memory for storage of said key database which can be accessed by said information transfer port.

9. The key of claim 8 wherein the information transferred also includes at least one instruction set to regulate the use of the key.

10. The key of claim 1 wherein said means for positioning said drive pins comprises n pin actuators, each associated with one of said n pins.

11. The key of claim 10 further comprising:

means for mechanically coupling said means for positioning said drive pins to said drive pins.

12. The key of claim 11 wherein said means for positioning said drive pins further comprises:

n servos.

13. The key of claim 12 wherein said means for mechanically coupling provides a reduction in displacement and is selected from the group of gear mechanisms; and lever arms.

14. The key of claim 1 for use with a base computer containing a master database of lock identifiers and corresponding lock pin configurations, the key further comprising:

an information transfer port for providing information exchange between said microprocessor and said base computer; and further wherein said microprocessor has an associated read-write memory for storage of said key database which can be accessed by said information transfer port.

15. The key of claim 14 wherein the information transferred also includes at least one instruction set to regulate the use of the key.

16. The key of claim 1 further comprising:

a pin latching mechanism which can be activated to block said pins from moving with respect to said base member once said pins have been moved to their correct positions to match the lock pin configuration for the selected lock.

17. The key of claim 16 wherein said means for positioning said drive pins comprises n pin actuators, each associated with one of said n pins.

* * * * *